US006551157B1

(12) United States Patent
Bishop

(10) Patent No.: US 6,551,157 B1
(45) Date of Patent: Apr. 22, 2003

(54) WATER VEHICLE STABILIZER AND ACCELERATOR

(76) Inventor: Lee Bishop, 721 NE. 38th St., Boca Raton, FL (US) 33431

( * ) Notice: Subject to any disclaimer, the term of this patent is extended or adjusted under 35 U.S.C. 154(b) by 0 days.

(21) Appl. No.: 09/868,511

(22) PCT Filed: Oct. 30, 2000

(86) PCT No.: PCT/US00/41699

§ 371 (c)(1),
(2), (4) Date: Jun. 19, 2001

(87) PCT Pub. No.: WO01/32499

PCT Pub. Date: May 10, 2001

Related U.S. Application Data

(60) Provisional application No. 60/163,076, filed on Nov. 2, 1999.

(51) Int. Cl.[7] ..... B63B 1/00
(52) U.S. Cl. ..... 441/65; 441/79
(58) Field of Search ..... 114/140; 441/65, 441/68, 74, 79

(56) References Cited

U.S. PATENT DOCUMENTS

| | | | | |
|---|---|---|---|---|
| 3,323,154 A | | 6/1967 | Lambach | 9/310 |
| 3,378,275 A | | 4/1968 | Rockwood et al. | 280/18 |
| 4,629,435 A | | 12/1986 | Pitcairn | 441/68 |
| 4,741,284 A | * | 5/1988 | Madison | 114/140 |
| 4,878,980 A | | 11/1989 | Stedman | |
| 4,923,427 A | | 5/1990 | Roland | 446/153 |

FOREIGN PATENT DOCUMENTS

| | | |
|---|---|---|
| AU | A-85 992/82 | 7/1982 |
| AU | A-74009/91 | 3/1991 |
| DE | 2928009 | 7/1979 |

OTHER PUBLICATIONS

Posi–Trak Channel Systems. advertisement in Body Boarding , undated, 2 pages.
Posi–Trak advertisement, undated, 1 page.

* cited by examiner

*Primary Examiner*—Stephen Avila
(74) *Attorney, Agent, or Firm*—Blank Rome LLP

(57) ABSTRACT

A water vehicle (10) has a stabilizer and accelerator device in the form of an elongated strip (20). The strip is designed to be sleek so that the water vehicle is not stiff and difficult or awkward to operate. Yet, the strip sufficiently protrudes outwardly and downwardly from the bottom of the water vehicle to influence the flow of water across the water vehicle resulting in increased speed, control and stabilization of the water vehicle. The strip has a cross section that is triangular in shape, but with curved side walls. The strip grips the water during turns for greater control and maneuverability and accelerating out of the turns.

24 Claims, 3 Drawing Sheets

WATER VEHICLE STABILIZER AND ACCELERATOR

The present case is based on WO 01/32499 which in turn is based on Provisional Application No. 60/163,076, filed Nov. 2, 1999, the priority of which is claimed; the subject matter of both applications are incorporated herein by reference in their entireties.

BACKGROUND OF THE INVENTION

1. Field of the Invention

The present invention relates to water vehicles. More particularly, the present invention relates to a stabilizer and accelerator for use with water vehicles, and especially surfboards.

2. Description of the Related Art

Water vehicles, such as boats and waterboards, are continually seeking ways to improve maneuverability, control and speed. This is especially true for water sports, where performance is measured in time and skill, such as for surfing, bodyboarding, windsurfing, sailboarding, kneeboarding, kiteboarding and wakeboarding. In these events, greater speed and control allows for riding of previously-unmanageable waves, the execution of more powerful, dramatic and spectacular maneuvers, and faster finishing times.

SUMMARY OF THE INVENTION

In view of the foregoing, one object of the present invention is to provide a water vehicle that has greater control, stability and speed. It is a further object of the present invention to provide a stabilizer for use with water vehicles that increases control, stability and speed.

In accordance with these and other objectives, a water vehicle stabilizer and accelerator is provided in the form of an elongated strip. The strip is designed to be sleek so that the water vehicle is not stiff and difficult or awkward to operate. Yet, the strip sufficiently protrudes outwardly and downwardly from the bottom of the water vehicle to influence the flow of water across the water vehicle resulting in increased speed, control and stabilization of the water vehicle. The strip has a cross section that is triangular in shape, but with curved side walls. The strip grips the water during turns for greater control and maneuverability and accelerating out of the turn.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
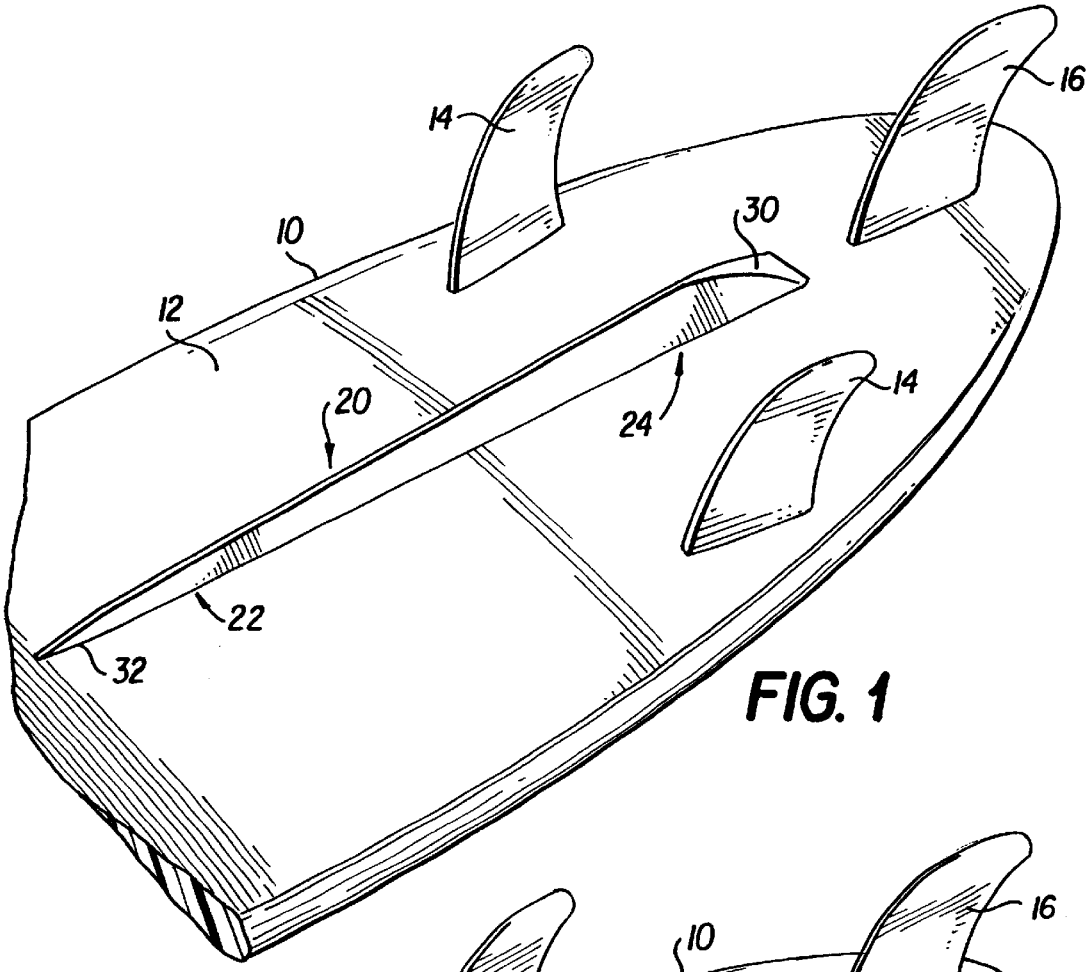
FIG. 1 is a perspective view of the water vehicle having a stabilizer strip in accordance with a preferred embodiment of the invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Turning to the drawings, FIG. 1 shows a stabilizer/accelerator used with a water vehicle 10 in accordance with the preferred embodiment of the invention. The stabilizer/accelerator generally has the shape of an elongated strip or body 20 having a front end portion 22 and a rear end portion 24. The strip 20 is designed to be sleek so that the water vehicle 10 is not stiff and difficult or awkward to operate. Yet, the strip 20 sufficiently protrudes outwardly and downwardly from the bottom 12 of the water vehicle 10 to influence the flow of water across the water vehicle resulting in increased speed, control and stabilization of the water vehicle 10.

Figure 2:
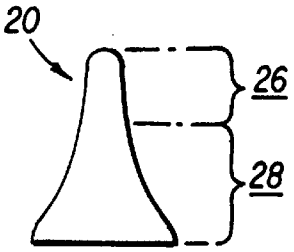
FIGS. 2 and 3 are cross-sections of the stabilizer strip.

As best shown in FIG. 2, the strip 20 has a cross section that preferably has a deflated triangular shape. The top 26 of the strip 20 is substantially straight, and the bottom 28 of the strip 20 is curved slightly inward to form a concave shape. Preferably, the strip 20 maintains that same shape the entire length of the strip 20 from the front end portion 22 to the rear end portion 24. However, in an alternative embodiment, the cross section of the strip 20 becomes less concave toward the front end portion 22 and the tip or nose section 32 of the strip 20 has a more rounded cross section with slightly concave sides. The rear end portion 24 has a tapered tail 30 that permits water to flow off the end of the strip 20 with minimal resistance, FIGS. 4, 5. Any suitable design shape can be used such as the triangular shape of FIG. 3.

Figure 4:
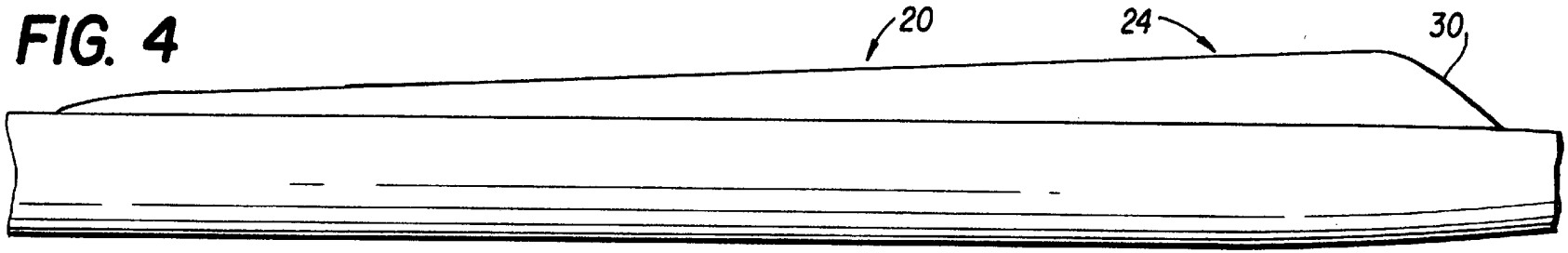
FIG. 4 is a side view of the stabilizer strip.
Figure 5:
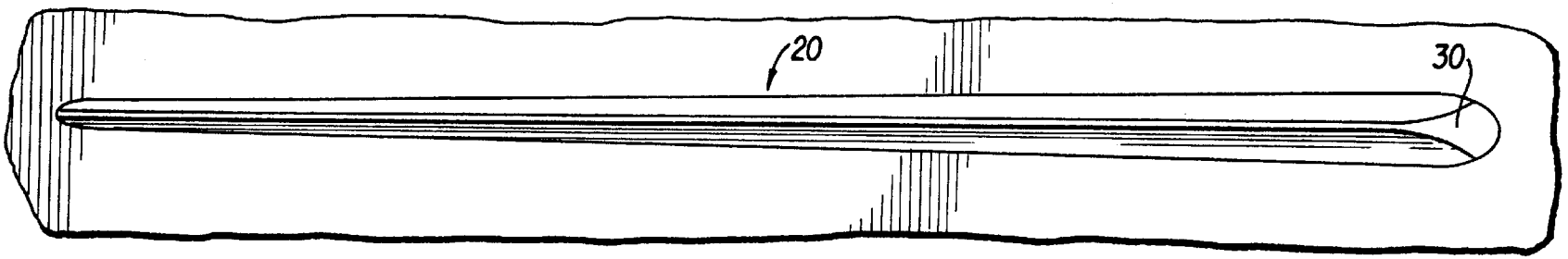
FIG. 5 is a top view of the stabilizer strip.

As shown in FIG. 4, the strip body 20 is low (having shallow depth of water penetration) at the front end portion 22 and steadily increases in height (thereby achieving greater depth of water penetration) to the tapered section 30 of the rear end portion 24. As shown in FIG. 5, the strip body 20 is narrow at the front end portion 22 and steadily increases in width to the rear end portion 24. The increasing height and width provides that the strip 20 is deepest and widest at the rear end portion 24 becoming shallower and narrower toward the front end portion 22. This allows for even and non-disruptive flow of water as the water vehicle 10 travels through the water. The strip 20 knifes through the water with minimal resistance by eliminating drag that might otherwise arise due to an asymmetrical flow of water about the strip 20.

In accordance with the preferred embodiment for use with a surfboard, the nose 32 is approximately 1/16th of an inch in height and the rear end portion 24 reaches a height of about 5/8th of an inch. However, a smaller height can be provided where the water vehicle 10 is used with small waves or has a low speed, and a greater height can be provided where the water vehicle is used with larger waves or has a high speed. The strip 20 is preferably provided in both 18- and 24-inch lengths, though the length can be anywhere from 8–30 inches. A surfboard 10 that is used with small waves would use a shorter strip 20 and a surfboard 10 that is used with large waves would use a longer strip 20.

The strip 20 is preferably used for surfboards, though is also suitable for any water vehicle or craft 10 such as for instance a boat, waterboard or the like. As shown in FIG. 1, the water vehicle 10 may have two side fins 14 and a rear fin 16. However, the water vehicle 10 may have a single rear fin 16, just the two side fins 14, or no fins at all. The strip 20 is preferably located symmetrically along a central longitudinal axis of the water vehicle 10.

In a preferred embodiment, the strip 20 is a separate piece that is secured to the bottom 12 of the water vehicle 10. The strip 20 has a smooth flat bottom that is secured to the water vehicle 10 with an adhesive. In an alternative embodiment, the strip 20 is formed integral to the water vehicle 10, for instance by shaping the strip 20 into the foam core of the water vehicle 10 by hand or by an automatic shaping machine.

Figure 6:
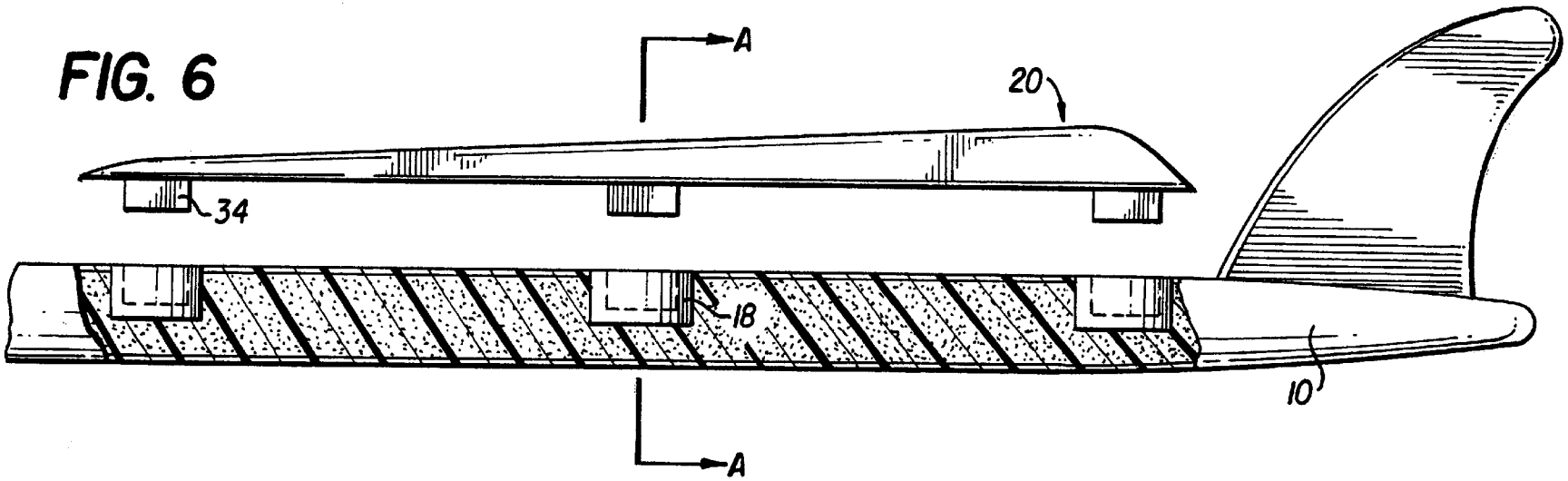
FIG. 6 is a side view showing one embodiment of the stabilizer strip being fastened to a water vehicle.
Figure 8:
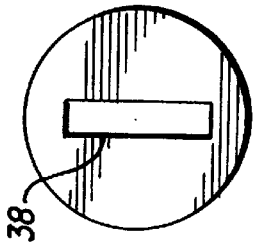
FIG. 8 is a top view of the receptacle shown in FIG. 5.
Figure 7:
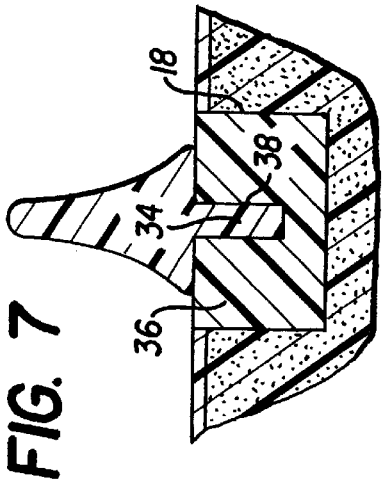
FIG. 7 is a cross-section taken along lines A—A of FIG. 5.

In yet another alternative embodiment, the strip 20 is secured to the water vehicle 10 by a fastening mechanism. One fastening mechanism is shown, for instance, in the embodiment of FIGS. 6–8. The strip 20 is provided with one or more downwardly extending tongues 34 that mate with a respective groove 38 of a receptacle 36. The receptacle 36 are circular in shape, FIG. 8, and received in a corresponding opening 18 in the water vehicle 10.

The tongues 34 preferably are secured to the grooves 38 by a fastener that extends from the receptacle 36 to the tongue 34. Alternatively, the tongue 34 can friction fit with the grooves 38 or can be adhered to the grooves 38. Likewise, the receptacle 36 can be friction fit, fastened or adhered to the opening 18. The tongues 34 and grooves 38 allow the strip 20 to be removed for repair or for replacement with strips 20 having different shapes, widths, lengths or heights. In addition, one long tongue 34 can extend a substantial portion of the strip 20 and mate with a correspond groove 38 formed in the water vehicle 20. Still yet, the grooves 38 can be formed directly in the bottom of the water vehicle 20 without use of a receptacle 36. In that case, the strip 20 can be formed as part of the mold cavity for the water vehicle 10.

Figure 9:
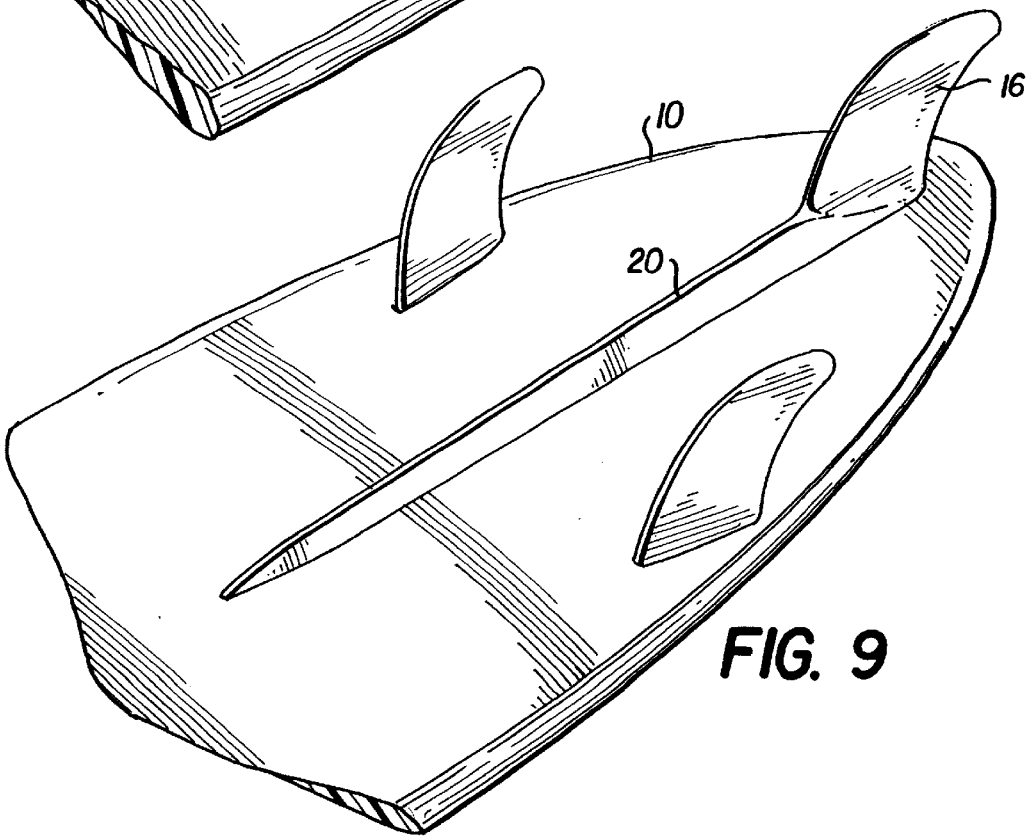
FIG. 9 is another embodiment of the invention in which the stabilizer strip is integrated with a fin.

As shown in FIG. 1, the strip 20 is placed in the pivot area or steering section of the water vehicle 10, preferably inset approximately 8¾ inches from the rear of the water vehicle 10 where there is no rear fin 16, and about 1 inch from any rear fin 16. In yet another embodiment of the invention, the strip 20 can extend to engage the side or rear fin 14, 16, or can be integrated with one of the side and/or rear fins 14, 16, as exemplified in FIG. 9. However, the strip 20 can be placed in any suitable position, and can fully extend to the rear edge of the water vehicle 10.

The strip 20 provides greater maneuverability, speed and stability to the water vehicle. The strip 20 grips the water (such as the face of a wave) during turns, allowing the user to remain in the curved part of the wave and maintain a straighter path. The strip 20 design permits water to travel longitudinally from the front of the water vehicle 10 toward the rear of the water vehicle 10 with minimal resistance. Since the strip 20 is symmetrical, water flows at an even rate around the sides of the strip 20, so that drag does not form.

At the same time, the strip 20 deflects the transverse flow of water to better grip the water during turns. This prevents the water vehicle 10 from drifting sideways as the water vehicle 10 is moved during turns or changes in direction, providing greater control and maneuverability. In addition, water deflects off of the strip 20 causing an acceleration in speed of the water vehicle 10 during turns.

Figure 3:
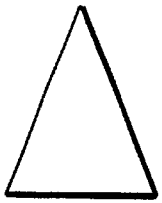

The strip 20 can be made with a wide variety of materials, such as for instance PVC, plastic, wood, epoxy, fiberglass, EVA, graphite or carbon fiber. The strip 20 can be adhered to the water vehicle 10 with any suitable adhesive, such as for instance silicon, resin, epoxy glue or double stick tape. The cross section shape of the strip 20 is exemplary only, and is not intended to be limiting. Any suitable cross section can be used, such as a triangular shape (FIG. 3). However, the shape should preferably be symmetrical about a longitudinal line of the water vehicle 10.

In addition, the strip 20 can be placed at a position offset from the center of the water vehicle 10 and more than one strip 20 can be used on the water vehicle 10. Thus, for instance, two strips 20 can be used at a position equally offset from either side of the center longitudinal axis of the water vehicle 10. The tail 30 is preferably tapered at about a 45° angle.

The foregoing description and drawings should be considered as illustrative only of the principles of the invention. The invention may be configured in a variety of shapes and sizes and is not limited by the dimensions of the preferred embodiment. Numerous applications of the present invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

What is claimed is:

1. A waterboard for use in water at high speeds, the waterboard comprising:

an elongated contoured body having a contoured bottom face with a longitudinal centerline axis and a plurality of grooves longitudinally spaced along said body substantially parallel to the centerline axis; and, at least one separate elongated projection removably connected to, and extending outwardly from, the bottom face of said body and located substantially parallel to the centerline axis of said body, said projection having a narrow cross-section with a substantially triangular shape which grips the water when turning the waterboard and has a substantially shallow depth of water penetration, wherein said projection improves maneuverability and acceleration of said waterboard, wherein each of said at least one projection has a plurality of tongues spaced along a length of said projection which extend outward from a bottom surface of said projection and are aligned to removably engage a respective one of the plurality of grooves to removably connect said at least one projection to said body.

2. The waterboard of claim 1, wherein said projection has two concave side walls that form the substantially triangular shape.

3. The waterboard of claim 1, wherein said projection has a triangular shape.

4. The waterboard of claim 1, wherein said projection has a tail that is abruptly tapered.

5. The waterboard of claim 1, wherein said projection increases in height from a front end of said projection to a rear end of said projection.

6. The waterboard of claim 1, wherein said projection increases in width from a front end of said projection to a rear end of said projection.

7. The waterboard of claim 1, wherein the central transverse line has a contoured shape.

8. The waterboard of claim 1, wherein said projection deflects water crossing transverse to the water board.

9. The waterboard of claim 1, wherein said projection includes a fin.

10. The waterboard of claim 1, wherein the at least one separate elongated projection is removably connected along the centerline of said body.

11. The waterboard of claim 1, wherein said projection is an elongated strip having a symmetrical shape.

12. The waterboard of claim 1, wherein said projection is symmetrical so that water flows at an even rate along sides of said projection.

13. The waterboard of claim 1, further comprising at least one fin extending outwardly from the bottom face of said body.

14. The waterboard of claim 1, wherein the contoured bottom face of said contoured body is flat.

15. A stabilizer for use with a waterboard of the type used in an ocean wave and having an elongated contoured body with a contoured bottom face with a longitudinal centerline axis and a plurality of grooves longitudinally spaced along said contoured body substantially parallel to the centerline axis, the stabilizer comprising an elongated body having a narrow cross-section with a substantially triangular shape which grips the wave when turning the waterboard and has a substantially shallow depth of water penetration, and a plurality of tongues spaced along a length of said body of the stabilizer which extend outward from a bottom surface of said body of the stabilizer and are aligned to removably engage a respective one of the plurality of grooves to removably connect said at least one projection to said contoured body of the waterboard to removably connect the elongated body to the waterboard.

16. The stabilizer of claim 15, wherein said elongated body has two side walls that are curved inwardly to form the substantially triangular shape.

17. The stabilizer of claim 15, wherein said elongated body has a tail that is abruptly tapered.

18. The stabilizer of claim 15, wherein said elongated body increases in height from a front end of said elongated body to a rear end of said elongated body.

19. The stabilizer of claim 15, wherein said elongated body increases in width from a front end of said elongated body to a rear end of said elongated body.

20. The stabilizer of claim 15, wherein said elongated body deflects water crossing transverse to the water vehicle.

21. The stabilizer of claim 15, wherein said elongated body includes a fin.

22. The stabilizer of claim 15, wherein said body has a longitudinal axis and said elongated body extends parallel to the longitudinal axis of said body.

23. The stabilizer of claim 15, wherein said elongated body is an elongated strip having a symmetrical shape.

24. The stabilizer of claim 15, wherein said elongated body is symmetrical so that water flowing longitudinal to said stabilizer flows at an even rate along sides of said elongated body.

* * * * *